US006263761B1

(12) United States Patent
Ryder

(10) Patent No.: US 6,263,761 B1
(45) Date of Patent: Jul. 24, 2001

(54) PILL BOTTLE OPENER

(76) Inventor: John C. Ryder, 4408 Huntington Woods, Wooster, OH (US) 44691

( * ) Notice: Subject to any disclaimer, the term of this patent is extended or adjusted under 35 U.S.C. 154(b) by 0 days.

(21) Appl. No.: 09/511,638

(22) Filed: Feb. 16, 2000

(51) Int. Cl.[7] ..... B67B 7/44
(52) U.S. Cl. ..... 81/3.09; 81/3.44; 7/151
(58) Field of Search ..... 81/3.07, 3.09, 81/3.36, 3.29, 3.4, 3.44, 3.55, 3.56; 7/151, 152, 156

(56) References Cited

U.S. PATENT DOCUMENTS

| | | | | |
|---|---|---|---|---|
| 913,336 | * | 2/1909 | Westerbeck | 81/3.44 |
| 1,361,639 | * | 12/1920 | Stevenson | 81/3.44 |
| 1,605,811 | * | 11/1926 | Danielson | 81/3.44 |
| 2,082,699 | * | 6/1937 | Keppinger | 81/3.44 |
| 2,523,544 | * | 9/1950 | Stamp | 81/3.44 |
| 2,729,125 | * | 1/1956 | Krzanowski | 81/3.09 |
| 2,990,213 | * | 6/1961 | Kolacinski | 81/3.44 |
| 4,179,954 | * | 12/1979 | Whalen | 81/3.44 |
| 4,442,735 | * | 4/1984 | Chance et al. | 81/3.09 |
| 4,509,784 | * | 4/1985 | Vollers | 81/3.44 |
| 5,161,435 | * | 11/1992 | Brannon | 81/3.09 |
| 5,655,806 | * | 8/1997 | Halladay et al. | 81/3.44 |

FOREIGN PATENT DOCUMENTS

| | | | | |
|---|---|---|---|---|
| 71129 | * | 12/1927 | (SE) | 81/3.44 |

* cited by examiner

*Primary Examiner*—Eileen P. Morgan
*Assistant Examiner*—Joni B. Danganan

(57) ABSTRACT

An opener for several different types of pill bottle caps and closures. In the preferred embodiment, the opener is molded as one piece of strong, flexible plastic material that can be repeatedly bent without failing. The opener has the shape of an arch, with a thin section at the top of this arch that acts as a hinge and return spring for the two legs of the arch, which are thicker in section and act as handles to react the forces applied by the user's band. The inside of each handle has a curved surface with teeth on its inside face to grip the outside of a bottle cap. The inside surface of each handle also has a triangular shaped lug that applies a downward force on the top of a bottle cap, and also applies an upward wedge force to pry a bottle cap free. At the bottom of each handle is a second curved surface, as viewed from below, which also has teeth for gripping the outside of a bottle cap. The side of each handle has a thin section blade which can cut and pry loose the seals on pill bottles, as well as pull the cotton packing from pill bottles.

8 Claims, 4 Drawing Sheets

PILL BOTTLE OPENER

CROSS-REFERENCE TO RELATED APPLICATIONS

Not applicable.

BACKGROUND—Field of Invention

This invention relates to bottle openers, specifically to an improved band-held tool for opening pill bottles.

BACKGROUND—Description of Prior Art

For reasons of safety, drug companies have been forced to sell their pills in bottles that are difficult to open. First, pill bottle caps are sealed by the companies to prevent tampering on the store shelves. Then, after these seals have been removed, pill bottles are required to have "child-proof" caps that make each opening of them difficult.

These "safety caps" make opening pill bottles especially difficult for older people. Ironically, this is the age group who must take the largest quantity of pills! Also, older people often have arthritis, or weaker fingers and hands in general. This further adds to the difficulty of opening pill bottles.

To complicate this problem more, drug companies have been very "creative" in the variety of "safety caps" they have devised. This variety of closures calls for a pill bottle opener that can assist the user in a several different modes. As the following will show, this invention describes a pill bottle opener that is unique in satisfying this requirement.

The prior art of existing openers have not met the users needs described above. Firstly, they are often designed to open types of bottles other than pill bottles. Therefore they lack the specific design features that pill bottle openers require. U.S. Pat. No. 4,846,024 to Bryant et al. is such an example. Even though it describes a three-way hand-held bottle opener, it is not well suited to opening the variety of closures of pill bottles.

Another example of this prior art is U.S. Pat. No. 4,455,894 to Roberts. Again this opener is better suited to opening beverage cans and bottles, but offers little application as a pill bottle opener.

Secondly, even though a device is designed as a pill bottle opener, it can lack the variety of features required to open the many types of pill bottles. U.S. Pat. Des. 286,734 to Furman is such an example. It shows a handle with a hooked blade for opening. Such a tool would cut and pry; but it lacks the pushing, clamping, and twisting functions required to open many pill bottles.

SUMMARY

The present invention comprises an opener that includes several functions in one tool capable of opening many styles of pill bottle caps and closures.

OBJECTS AND ADVANTAGES

Besides the advantages of this patent that were introduced above, several objects and advantages of the present invention are:

a) to provide a hand-held tool that will make it easy for the user to open a variety of pill bottle caps and closures;

b) to provide a mechanical advantage to the user so that the force exerted by his/her hand to the tool will exert a greater force on the bottle cap and therefore make opening the pill bottle much easier;

c) to provide the means in one simple tool so that the user will be able to easily remove a variety of seals that have been affixed to the pill bottle by the manufacturer to prevent tampering on the store shelves;

d) to provide in one device several different tool elements, each of which has a particular method of engaging a pill bottle cap, so as best to remove that particular cap;

e) to provide a tool that is simple in its appearance and in its function, so that the user will find its variety of uses obvious, and easy to understand and use;

f) to provide a tool that is safe and efficient for the user to operate;

g) to provide a tool that is relatively simple to design and produce, so that the manufacturer can bring the pill bottle opener to the market in a minimum amount of time and with a minimum amount of development and tooling expenses;

h) to provide a tool that is relatively inexpensive to produce so that the manufacturer can realize a profit while offering the pill bottle opener to the public at a reasonable price—which is especially important to senior citizens;

Further objects and advantages are to provide a pill bottle opener that can be produced in several different configurations so that the manufacturer can select the best configuration for his facility. Still further objects and advantages will become apparent from a consideration of the following description and drawings.

DRAWING FIGURES

Figure 1:
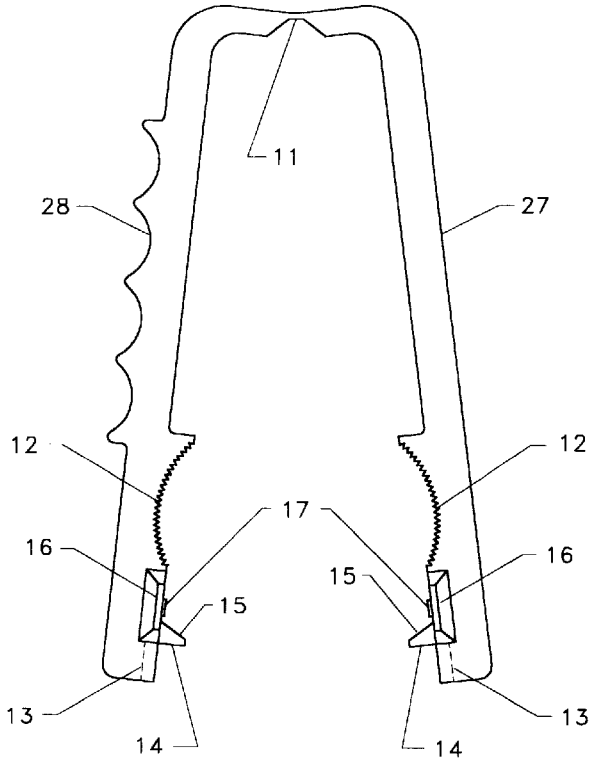
FIG. 1 shows a front elevation of the pill bottle opener as molded in one piece, and shown in its as-molded (relaxed) position.

| Reference Numerals In Drawings | |
|---|---|
| 11 hinge | 12 handle grip teeth |
| 13 end grip teeth | 14 force lug |
| 15 pry surface | 16 blade |
| 17 barb | 18 pivot pin |
| 19 spring | 20 female boss |
| 21 male boss | 22 stop block |
| 23 formed handle | 24 hinge-spring |
| 25 blade edge | 26 tool block |
| 26A tool block - opp. hand | 27 palm handle |
| 28 finger handle | |

DESCRIPTION FIG. 1—Preferred Embodiment

A preferred embodiment of the pill bottle opener is illustrated in FIG. 1. In this configuration, the pill bottle opener is molded in one piece from a strong, flexible, plastic material such as polyethylene, polypropylene, vinyl, nylon, or various impregnated or laminated materials that can be repeatedly bent without fracturing.

A palm handle 27 provides a member for the user's palm to engage. A finger handle 28 provides a member for his/her fingers to engage. Therefore, by squeezing these two handles toward each other, the user engages the pill bottle opener in its various functions described below. The cross sections of both of the handles provide sufficient strength to allow the user to squeeze the pill bottle opener firmly, while not causing noticeable bending of the handles.

A hinge 11 is formed by creating a thin cross section between the palm handle 27 and the finger handle 28. By its design, the binge performs two functions. First, it is flexible enough to allow the palm handle and the finger handle to be moved toward each other with a light hand squeeze force by the user. Second, it is thick enough that it can return the palm handle and the finger handle back to the position shown in FIG. 1, when the user releases the pill bottle opener. In this function, the hinge acts as a spring.

On the lower section of each handle is a handle grip teeth 12. The handle grip teeth are formed on a curved inside surface of each handle. The inside radius of the handle grip teeth is that of the largest radius bottle cap to be opened, so that the complete range of bottle cap outside diameters will be properly engaged. The handle grip teeth are serrated with "teeth" or other similar surface preparation, so as to grip the bottle cap and therefore allow an adequate twisting moment to be applied to the bottle cap for its removal.

Below the handle grip teeth on each handle is a force lug 14. Each force lug extends inward from the inside surface of its handle. The force lugs act as a pair to apply a downward force on the top of the bottle cap. As the user squeezes the handles together, the lower surface of the two force lugs bear against the top surface of the cap.

The top surface of each force lug forms a pry surface 15. The pry surface is angled upward from its inside edge to its intersection with the handle. Therefore, its inner edge forms a thin wedge surface with the inner edge of the lower surface of its corresponding force lug. As will be shown below, the two pry surfaces therefore act together to pry the caps off certain type of bottles.

Figure 4:
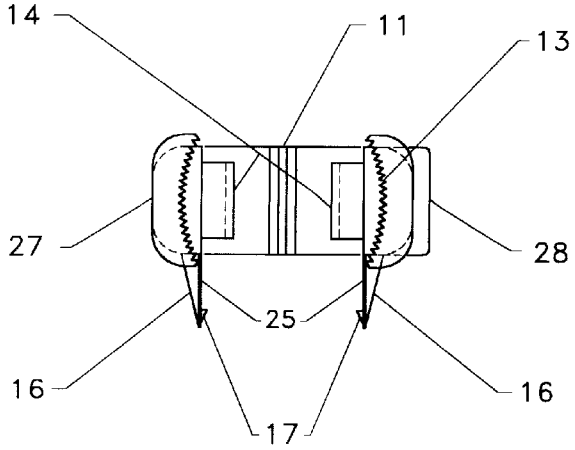
FIG. 4 shows a bottom view of the pill bottle opener.

At the lower end of each handle is a end grip teeth 13. The end grip teeth are also shown more clearly in the bottom view of FIG. 4. The end grip teeth are molded to the same contour as the handle grip teeth 12 described above. Therefore, the inside surface of the end grip teeth is the same as the inside surface of the handle grip teeth. The difference between the two types is that the handle grip teeth engage the bottle cap with the handles in a horizontal position, while the end grip teeth engage the cap with the handles in a vertical position, above the cap. The end grip teeth act in conjunction with the force lugs 14 to remove a type of cap as is described in detail below.

Protruding from the side of each handle just above the end grip teeth is a blade 16. The profile of each blade is in shape as—shown in the bottom view of FIG. 4. Each blade is relatively wide and thick at its base at the side of the handle. This gives the blade enough strength to perform its cutting and prying functions as described below. The blade is then tapered in two planes toward its tip, where its form is relatively thin and narrow.

The outer edge of each blade 16 is also beveled on three edges to form a blade edge 25. The blade edge gives the blade sharper surfaces with which to pry and perform light cutting functions as described below.

Also, on the inside surface each blade is a barb 17. The shape of the barb is best viewed in FIG. 4. The barb is tapered in section so that it is narrow at the tip of the blade, then widens at its upper edge toward the base of the blade. With this shape it can pass easily through material as the blade is pushed into a material, but will tend to snag and pull on the material as the blade is withdrawn.

Figure 2:
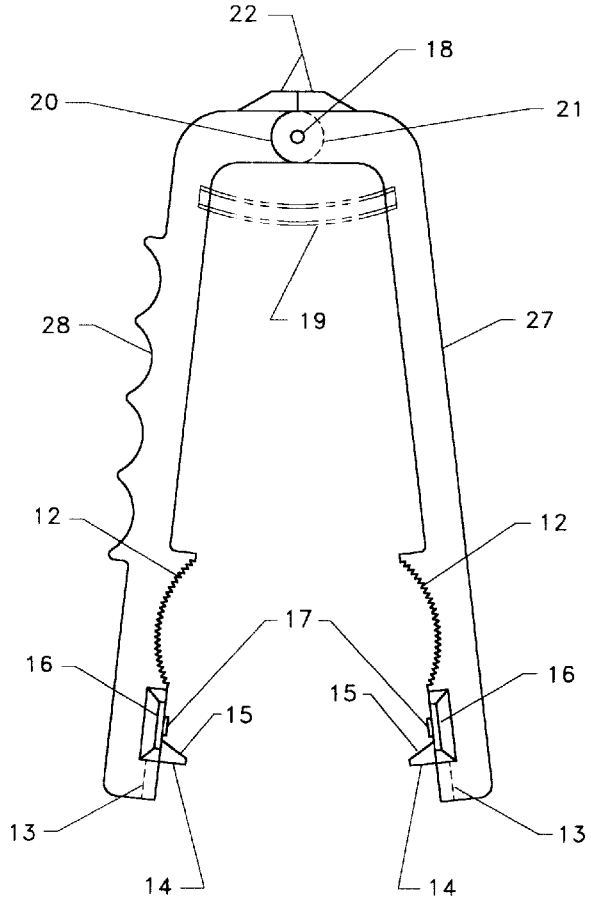
FIG. 2 shows a front elevation of the pill bottle opener molded as two pieces and fitted with a spring and pivot pin.

FIG. 2—Alternative Embodiment 1

FIG. 2 shows the first alternative embodiment of the pill bottle opener. The function of the pill bottle opener is the same as described in the preferred embodiment above. The only difference is that in this version the opener is molded in two pieces rather than one piece.

Therefore, at the upper end of palm handle 27 is molded a female boss 20. And at the upper end of finger handle 28 is molded a male boss 21. These bosses are formed so that the male boss fits inside the two lobes of the female boss, allowing a pivot pin 18 to be pressed into holes that align in both bosses. The pivot pin is made of a metal or wood or similar high strength material so that it can resist the clamping forces applied by the users hand.

It is also possible to duplicate the function of the pivot pin by molding male "cusps" into one boss, and female "depressions" into the other handle's boss so that the two handles "snap" together and thereby pivot relative to each other.

A spring 19 is fitted between the two handles so that it applies a light separating force between the handles. Although a compression type spring is shown in FIG. 2, the spring could also be a torsional type concentric with the pivot pin, or a simple spring clip.

To stop the handles at the position shown in FIG. 2, each handle has molded at its top surface a stop block 22. The stop block on the palm handle contacts the stop block on the finger handle to prevent the handles from moving to far apart due to the force of the spring.

The stop blocks also maintain a light separating force from the spring onto the handles.

Figure 3:
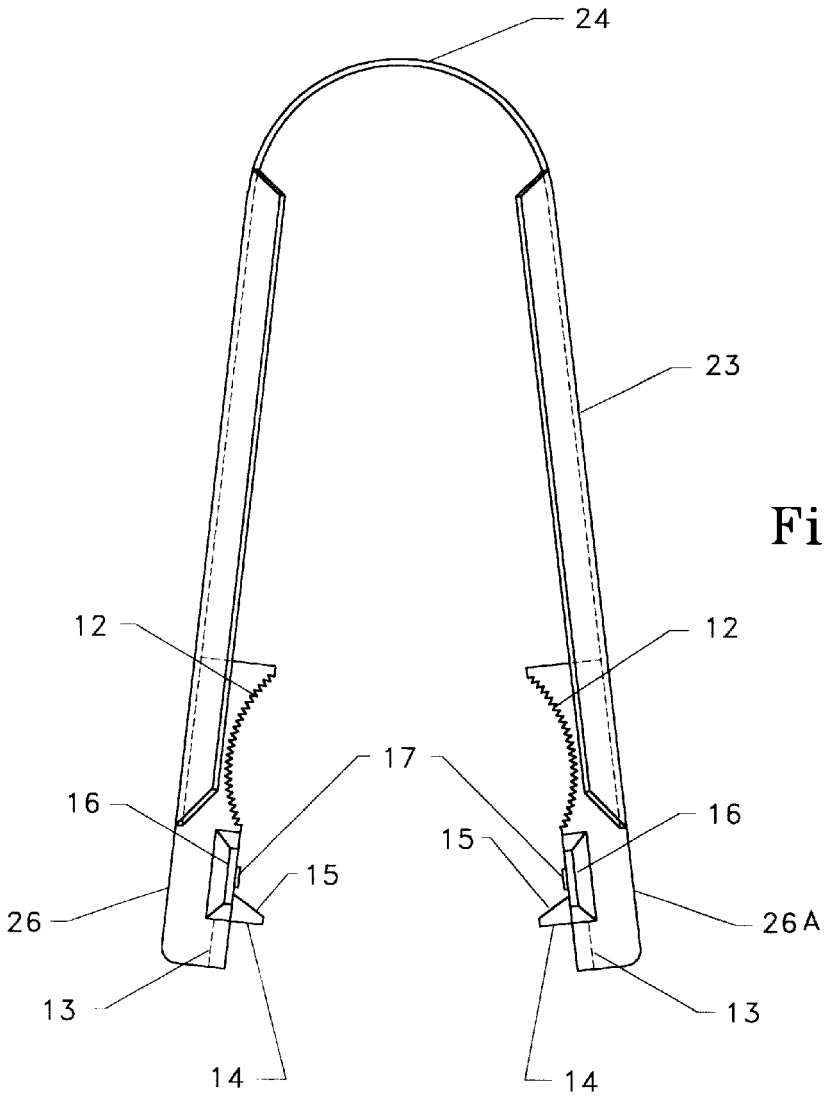
FIG. 3 shows a front elevation of the pill bottle opener with a formed handle and two molded tool blocks.

FIG. 3—Alternative Embodiment 2

FIG. 3 shows a second alternative embodiment of the pill bottle opener. As described above, this version is functionally the same as the preferred embodiment. The only difference is that this version is assembled in three pieces.

The lower portion of the pill bottle opener in this configuration includes a tool block 26, and a tool block—opposite hand 26A. These tool blocks are molded from the same material as described in the preferred embodiment above, and are mirror opposites of each other.

At the upper portion of this opener is a formed handle 23. This handle is formed of a metal stamping or of a material capable of equivalent strength and flexibility. The formed handle provides the gripping surface for the users band. In its lower portion, the cross section of the formed handle is curved as shown in FIG. 3. This gives the handle the strength to transfer the gripping forces from the users hand to the tool blocks below.

At the top of the formed handle is a hinge-spring 24. Like the hinge 11 of Fig 1, the hinge-spring performs two functions. First it is flexible enough to allow the user to easily squeeze the handle together, and second it is resilient enough to act as a spring and return the handle to its original position shown in FIG. 3.

The formed handle 23 can be joined to the two tool blocks 26 and 26A by different means, including but not limited to:

the handle can be secured with screws or similar fasteners forced into the rear surface of the tool blocks; and the handle could be directly bonded to the tool blocks during their molding process.

The above preferred embodiment and the two alternative embodiments illustrate different means of manufacturing the pill bottle opener. It is probable that another manufacturing facility would adapt the pill bottle opener slightly to best fit their particular techniques. However, as the above demonstrated, the basic concept and function of the pill bottle opener does not change with these adaptations.

Operation—FIGS. 5, 6, 7, 8

Each mode of operation described below shows how the pill bottle opener is adapted to open a particular type of pill bottle cap or closure.

Figure 5:
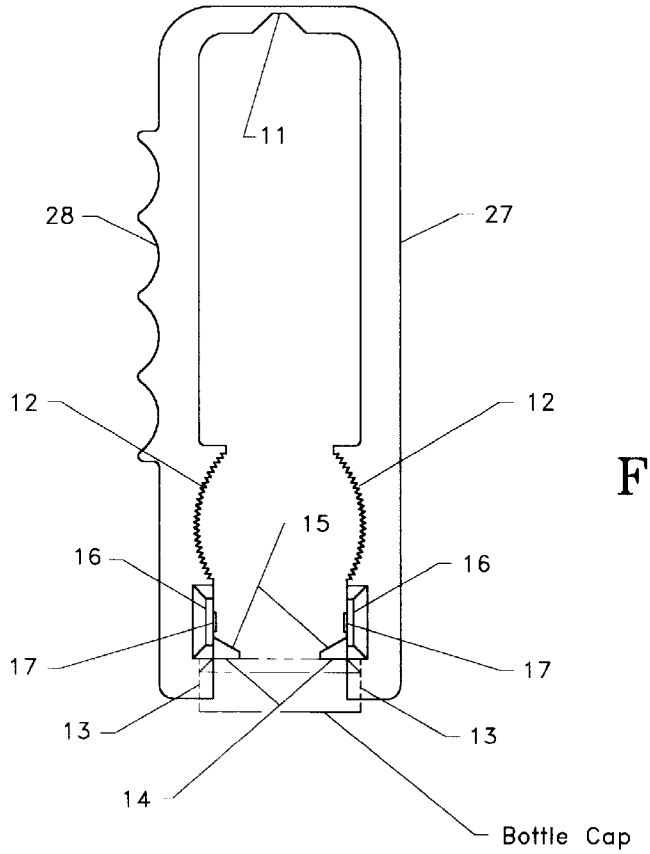
FIG. 5 shows the pill bottle opener removing a cap that requires a downward force along with a twisting motion.

The first mode of operation is shown in FIG. 5. The bottle cap to be opened in this mode requires a force downward along with a twisting of the cap. Therefore, the user grips the opener palm handle 27 and finger handle 28 and squeezes until the outside diameter of the cap is contacted by the end grip teeth 13. The user then pushes downward to force the two force lugs 14 against the top of the cap. A twist of the handles then removes the bottle cap.

Figure 6:
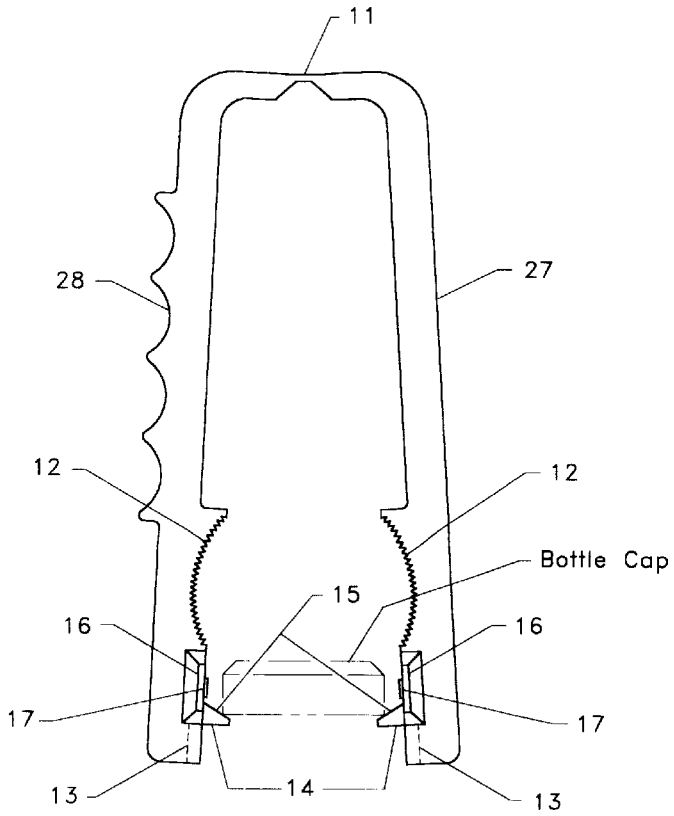
FIG. 6 shows the pill bottle opener prying the cap from a pill bottle.

The second mode of operation is shown in FIG. 6. This bottle cap requires that it be pried upward with a force applied below the lip at the edge of the cap. To open this type of cap, the user squeezes the handles until the pry surface 15 on each handle is engaged below the lower lip of the cap on both sides. While continuing to squeeze the handles, the user then pulls the handles to the right (as viewed in FIG. 6) which applies an upward force by the pry surface 15 onto the cap and removes it.

Figure 7:
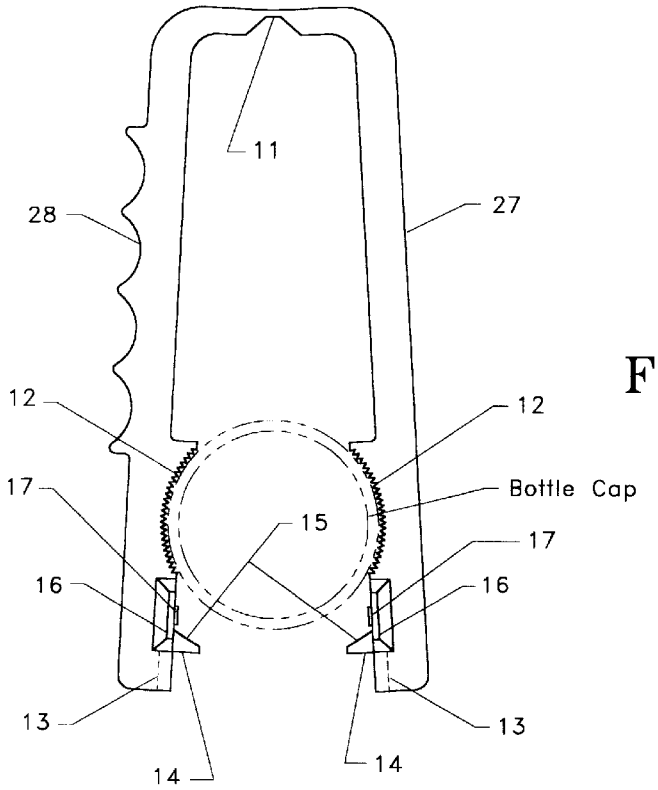
FIG. 7 shows the pill bottle opener twisting the cap from a pill bottle.

The third mode of operation is shown in FIG. 7. To remove this bottle cap requires a relatively high twisting torque be applied. Therefore, with the bottle to be opened upright and the pill bottle opener in a horizontal position, the user squeezes the handles until the handle grip teeth 12 contact the outside diameter of the cap. Then by rotating the handles in a counterclockwise direction (as viewed in FIG. 7) the bottle cap will be removed.

Figure 8:
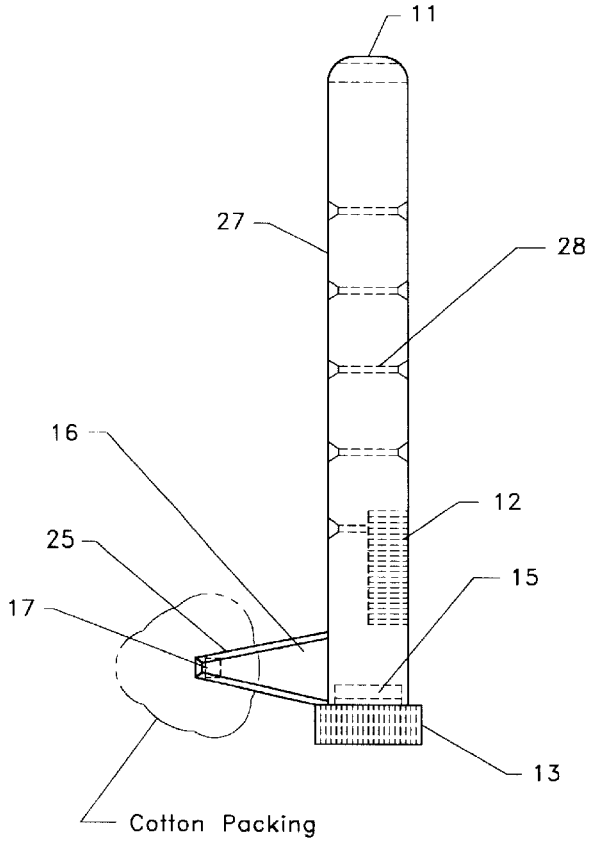
FIG. 8 shows a side elevation of the pill bottle opener removing the cotton packing from a pill bottle.

The fourth mode of operation is shown in FIG. 8. In this mode, the pill bottle opener is removing the cotton packing from a newly opened pill bottle. To complete this operation, the user squeezes the handles together until both blades 16 just fit inside the neck of the pill bottle. Then by pressing the blades downward, the blades slide along into the cotton packing allowing the barbs 17 to snag the cotton. Puffing upward while squeezing the handles removes the cotton.

The fifth mode of operation also utilizes the blade 16. In this mode, the pill bottle opener is used to cut the seal from the neck of the pill bottle. Some drug manufacturers bond a thin plastic or paper seal to the top of the bottle neck. This seal is encountered after the bottle cap has been removed for the first time. To remove this seal, the user first pushes the blade edge 25 of the blade 16 through this seal near the lip of the bottle neck. Then he/she draws the blade edge around the inside diameter of the bottle neck, cutting the seal from the bottle.

The sixth mode of operation also uses the blade 16. Some pill bottles come from the manufacturer with a plastic seal that is shrink-wrapped over the bottle cap and top of the bottle. This seal can be removed by peeling away a thin section of the seal that is marked by two rows of perforations; a difficult task with the users finger nail. But the tip of the blade 16 can be used to slide under the top edge of the shrink-wrap and pry back a length of the removable section. The seal is then easily pulled free of the bottle.

CONCLUSIONS, RAMIFICATIONS, AND SCOPE

From the above descriptions the reader will see that the pill bottle opener of this invention provides a high reliable, easy to use, and very adaptable tool for opening a great variety of pill bottles. Further advantages of this invention include:

Although this tool is specifically designed for the unique bottle caps and closures specific to pill bottles; some of its functions, such as the handle grip teeth 12, can be used to open bottle caps of different types of bottles.

Although the blades 16 are designed to remove the cotton packing from pill bottles, they can serve other functions such as removing pills from bottles when the pills have gotten "wedged" in the bottle or stuck to other pills due to moisture present While the above descriptions contain many specific examples, these should not be construed as limitations on the scope of the invention, but rather as examples of the preferred forms of the pill bottle opener. The shape or the materials used could be altered from those described and not change the basic function of the pill bottle opener. For example:

The shape of the pill bottle opener could be altered from that shown in FIG. 1 through FIG. 8. This could be done to give a more "artistic" look, for example. Or to allow for "draft" in a molding or casting operation, the shape shown in the Figures could be modified.

The proportions of the various elements of the pill bottle opener could be changed from those shown in the Figures. For example, the handles could be lengthened or shortened from those shown.

Elements of the pill bottle opener could be moved relative to one another. For example, the handle grip teeth 12 could be moved up the handles 27 and 28.

The materials used to manufacture the pill bottle opener could be changed. For example, as described above, the opener is shown molded from a plastic type material. It would also be possible to mold or cast the opener shown in FIG. 2 and FIG. 3 from a metal such as a aluminum or a type of "pot metal".

Accordingly, the scope of this invention should not be determined solely by the embodiments illustrated, but also by the appended claims and their legal equivalents.

I claim:

1. A pill bottle opener, comprising:

two shaft-like members having a contoured cross-section; the shaft-like members being joined at their upper ends; a middle section of each shaft-like member forming a handle; an inside surface of each shaft-like member having first and second curved sections with serrated surfaces, the first and second curved sections being perpendicular to one another; a triangular-shaped wedge being affixed to the inside surface of each shaft-like member between the first and second curved sections, a top surface of each wedge being sloped upward from its tip to the inside surface of the shaft-like member; and a beveled blade formed on a side surface of each shaft-like member, each blade being narrow at its tip and wider at its base where it joins the shaft-like member.

2. The pill bottle opener as set forth in claim 1, wherein each blade includes a barb at its tip for pulling cotton packing from inside a pill bottle.

3. The pill bottle opener as set forth in claim 1, wherein the opener is made from a unitary plastic material.

4. The pill bottle opener as set forth in claim 1, wherein the shaft-like members are formed as two separate plastic elements.

5. The pill bottle opener as set forth in claim 4, wherein each shaft-like member includes a through-hole at its upper end for receiving a pivot pin.

6. The pill bottle opener as set forth in claim 5 including a spring between the shaft-like members for spreading the shaft-like members to a maximum separation when released.

7. A pill bottle opener, comprising:

an upper element made from a flexible sheet metal; two shaft-like members being joined at lower extensions of the upper element; an inside surface of each shaft-like member having first and second curved sections with serrated surfaces, the first and second curved sections being perpendicular to one another; a triangular-shaped wedge being affixed to the inside surface of each shaft-like member between the first and second curved sections, a top surface of each wedge being sloped upward from its tip to the inside surface of the shaft-like member; and a beveled blade formed on a side surface of each shaft-like member, each blade being narrow at its tip and wider at its base where it joins the shaft-like member.

8. The pill bottle opener as set forth in claim 7, wherein each blade includes a barb at its tip for pulling cotton packing from inside a pill bottle.

* * * * *